US006186495B1

(12) United States Patent
Itano et al.

(10) Patent No.: US 6,186,495 B1
(45) Date of Patent: Feb. 13, 2001

(54) PROCESS FOR FEEDING RECORDING MEDIUM AND PACKAGE OF RECORDING MEDIUM

(75) Inventors: Masaaki Itano; Hiroyuki Onishi, both of Suwa (JP)

(73) Assignee: Seiko Epson Corporation, Tokyo (JP)

( * ) Notice: Under 35 U.S.C. 154(b), the term of this patent shall be extended for 0 days.

(21) Appl. No.: 08/744,959

(22) Filed: Nov. 7, 1996

(30) Foreign Application Priority Data

Nov. 19, 1995 (JP) ..... 2-89629
Oct. 19, 1996 (JP) ..... 2-84248

(51) Int. Cl.[7] ..... B65H 3/30
(52) U.S. Cl. ..... 271/121; 271/167
(58) Field of Search ..... 271/121, 124, 271/127, 167

(56) References Cited

U.S. PATENT DOCUMENTS 4,350,328 * 9/1982 Katakura et al. ..... 271/127
4,993,698 * 2/1991 Buelens et al. ..... 271/167
5,062,602 * 11/1991 Kress ..... 271/104
5,316,284 * 5/1994 Bolognese et al. ..... 271/121

FOREIGN PATENT DOCUMENTS 57-135190 * 8/1982 (JP) .
58-211489 * 12/1983 (JP) .
63-264391 * 1/1988 (JP) .
63-151476 * 6/1988 (JP) .
01232080 * 9/1988 (JP) .
1127532 * 5/1989 (JP) .
02113986 * 4/1990 (JP) .
57082085 * 5/1990 (JP) .
4153137 * 5/1992 (JP) .
06079967 * 3/1994 (JP) .
07068871 * 3/1995 (JP) .
07108727 * 4/1995 (JP) .
7125423 * 5/1995 (JP) .
7266550 * 10/1995 (JP) .
08169175 * 7/1996 (JP) .

OTHER PUBLICATIONS

Patent Abstracts of Japan of JP 7–266,550 of Oct. 1995.*
Patent Abstracts of Japan JP 1127532 May 5, 1989.*
Patent Abstract of Japan JP 7266550 Oct. 17, 1995.*
Patent Abstract of Japan JP 7125423 May 16, 1995.*
Patent Abstract of Japan JP 58211489 Dec. 8, 1983.*
Patent Abstract of Japan JP 4153137 May 26, 1992.*
Japanese Patent Abstract in English for JP 57082085.*
Japanese Patent Abstract in English for JP 51135190.*
Japanese Patent Abstract in English for JP 63151456.*
Japanese Patent Abstract in English For JP 63264391.*
Japanese Patent Abstract in English For JP 01232080.*
Japanese Patent Abstract in English For JP 02113986.*
Japanese Patent Abstract in English for JP 0607996.7.*
Japanese Patent Abstract in English for JP 07068871A.*
Japanese Patent Abstract in English for JP 071087278.*
Japanese Patent Abstract in English for JP 08169175.*

* cited by examiner

*Primary Examiner*—Gregory A. Morse
(74) *Attorney, Agent, or Firm*—Ladas & Parry

(57) ABSTRACT

There is provided a process for feeding in a recorder a recording medium having a glossy surface from a tray in which the recording media is loaded and piled up, in which the last sheet of the recording medium can be fed smoothly without adsorption to the tray. An extra sheet is laid between the tray and the recording media in order to prevent the adsorption of the last recording medium to the tray and to ensure that the last sheet of the recording medium is also led out smoothly from the tray.

8 Claims, 1 Drawing Sheet

PROCESS FOR FEEDING RECORDING MEDIUM AND PACKAGE OF RECORDING MEDIUM

BACKGROUND OF THE INVENTION

Field of the Invention

The present invention relates to a process for feeding recording media into a recorder such as a printer, a facsimile, a copying machine and the like, and to a package form of recording media used for the process.

Background Art

As a process for feeding a recording medium such as paper into a recorder such as a printer, a facsimile or a copying machine, there is generally employed a method comprising the steps of loading and piling up recording media in a housing such as a tray, drawing out a recording medium one by one from the housing with use of a feeding device such as a feeding roller pressed against the recording medium, and feeding the recording medium into the recorder.

On the other hand, recording media which have been subjected to various processings have been recently used to realize high quality printing. For example, a recording medium having the surface which is smoothed to add gloss to it has been used. Furthermore, a recording medium having a layer for receiving a coloring material such as an ink composition for the purpose of realizing a high quality printed image. The recording-medium-housing such as a tray or the recording medium feeding system of a recorder is generally designed on the assumption of employing plain paper. When the treated recording medium mentioned above is fed into such a recorder, the glossy surface of the recording medium is sometimes adsorbed on a tray and thus the last recording medium fails of being fed smoothly from the recording-medium-housing.

SUMMARY OF THE INVENTION

An object of the present invention is to provide a process for feeding smoothly the last recording medium in a recording medium feeding system.

Another object of the present invention is to provide a packed product of recording media used for the process according to the present invention.

Thus, the present invention provides a process for feeding a recording medium into a recorder from a housing in which recording media are loaded and piled up, comprising the steps of:

providing the extra sheet between the housing and the piled recording media, pressing a member against the recording medium in the housing, and operating the member in such a manner that the recording medium is drawn out from the housing to feed the recording medium to the recorder, wherein the following equation is satisfied:

$$\mu a \geqq \mu c \text{ and } \mu b > \mu c$$

where $\mu a$ represents coefficient of static friction between the member and the surface of the recording medium against which the member is pressed, $\mu b$ represents coefficient of static friction between the extra sheet and the surface of the housing, and $\mu c$ represents coefficient of static friction between the extra sheet and the surface of the recording medium which faces the surface of the housing, Furthermore, the present invention also provides a packed product of the recording media used for the process according to the present invention comprises the packed product of the recording media which are piled up and the extra sheet.

DETAILED DESCRIPTION OF THE INVENTION

Figure 1:
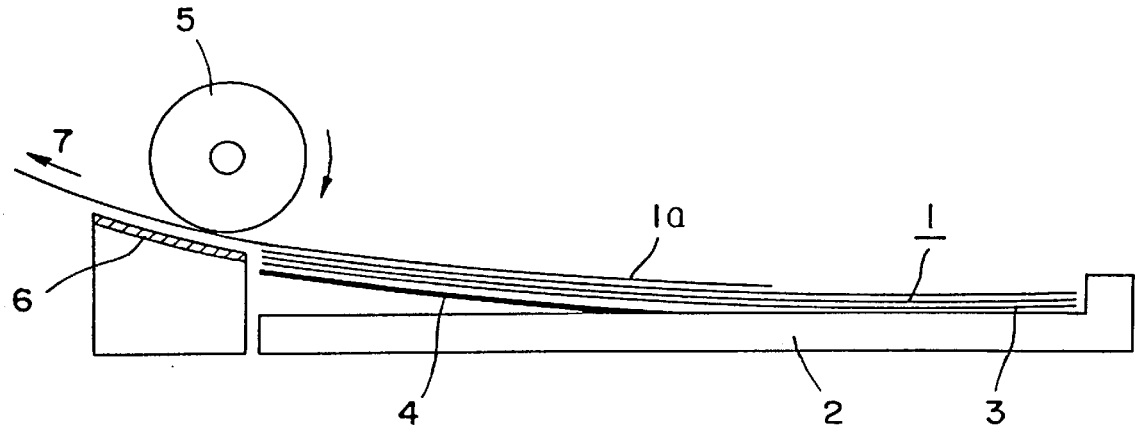
FIG. 1 is a diagram of a recording medium feeding system in which the process according to the present invention is carried out.

The process according to the present invention is now described with reference to the drawings. FIG. 1 is a diagram illustrating the process according to the present invention. In the figure, the recording media 1 are loaded and piled up in a tray 2 as the recording-medium-housing, and an extra sheet 3 is laid between the tray 2 and the recording media 1. The recording media 1 is loaded in the tray 2 is lifted by a spring panel 4 provided in the tray 2. A feeding roller 5 is pressed against the recording media 1 which is lifted by the panel 4, and the top recording medium 1*a* is drawn out from the tray with the rotation of the feeding roller 5. The recording medium 1*a* is moved with sliding on a separating pad 6 such as an urethane resin, a foamed urethane, an ether type urethane rubber, a combination of a cork and a rubber, and an elastomer so that it is fed by the rotation of the feeding roller 5 to the direction of an arrow 7 where the recorder is placed.

The member for drawing out the recording medium from the tray can be in the form of a feeding roller the surface of which may be rough or ground and comprises a chlorinated polyethylene, an ethylene-propylene rubber, and the like. The recording medium feeding systems with such a member is well known in the art and described for example in Japanese Patent Laid-Open Publication Nos. 68871/1995, 108729/1995 and 232080/1989. More specifically, there are marketed extensively DJ-56OC (Hewlitt-Packard), MJ-700V2C and MJ-5000C (Seiko Epson) as the system in which paper is fed from the front side of a printer and turned around to be discharged from the front side; BJC-400J (Canon), MJ-800C and MJ-500C (Seiko Epson) as the system in which paper is fed from the rear side of a printer and discharged from the front side.

Figure 2:
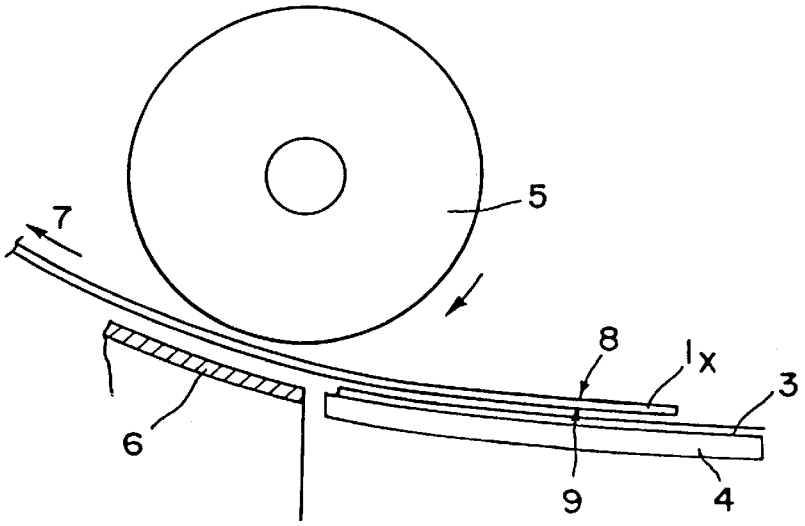
FIG. 2 is a diagram for illustrating the state that the last sheet of the recording media is fed smoothly according to the process of the present invention.

When the recording media 1 have been fed sequentially, there comes finally the turn of the last recording medium. According to the present invention, the last sheet of the recording medium can be smoothly fed. The sequence is described with reference to FIG. 2. In FIG. 2, the numeral 1*x* indicates the last sheet of the recording medium, the numeral 8 indicates the surface of the recording medium 1*x* which is contacted with the feeding roller 5 and the numeral 9 indicates the surface of the tray side. The coefficient of static friction between the surface of the feeding roller 5 and the surface 8 of the recording medium 1*x* and the surface of the panel 4 in the tray 2 is represented by $\mu b1$. If the last sheet is not fed, the relation between $\mu a$ and $\mu b1$ is $\mu a \leqq \mu 1$. In the present invention, an extra sheet 3 is laid between the recording medium 1*x* and the tray 2, i.e. the panel 4 of the tray 2. The extra sheet 3 is designed to satisfy the following relationship: $\mu a > \mu c$ and $\mu b > \mu c$, wherein $\mu b$ represents coefficient of static friction between the sheet 3 and the surface of the panel in the tray 2, and $\mu c$ represents coefficient of static friction between the sheet 3 and the surface 9 of the recording medium. It is thus possible to feed smoothly the last sheet of the recording medium 1*x*.

The specific example of the recording medium used for the process according to the present invention includes a recording medium which tends to have a relationship $\mu a \leqq \mu b1$. More specifically, the example includes a recording medium, of which one surface is hard to slide as a result of a certain treatment on the surface. The examples of such recording media include those medium having a surface which contains a plastic pigment and have been subjected to heat calendering as described in Japanese Patent Laid-Open Publication Nos. 82085/1982 and 135190/1982; those obtained by the casting method as described in Japanese Patent Laid-Open Publication Nos. 264391/1988 and 113986/1990; those prepared by the method in which the outermost ink receiving layer in an oil wet state is pressed against a heated mirror surface to dry as described in Japanese Patent Laid-Open Publication No. 79967/1994; those prepared by a method as described in Japanese Patent Laid-Open Publication No. 151476/1988 which comprising coating a base sheet or an ink receiving layer provided on a beam sheet with a gloss layer coating composition, laminating a film having a smooth surface on the coating, drying the coating, and peeling off the film; those prepared by coating a mirror metal roll or a highly smooth synthetic film with a composition of a gloss layer comprising colloid particles and a particular ionizing radiation hardening compound, evaporating a solvent, curing the gloss layer with the ionizing radiation before the roll or the film is peeled off as described in Japanese Patent Laid-Open Publication No. 169175/1996; and a recording paper or film to which gloss is afforded by coating with a resin which is dissolved in or swollen with an ink.

In the general paper feeding system with a roller of which the surface has a material comprising a chlorinated polyethylene rubber and a tray of which the surface has a material comprising a PS (polystyrene) resin or an ABS (acrylonitrile-butadiene-styrene copolymer) resin, when a recording medium having the glossy surface as disclosed above is placed in the direction of the tray side, the coefficient of static friction ($\mu a$) between the feeding roller and the untreated surface, i.e. the non-glossy surface, of the recording medium remains in the level of 0.5–3, whereas the coefficient of static friction ($\mu b1$) between the tray and glossy surface of the recording medium becomes 1–4. As a result, the last sheet of the recording medium tends to be fed only without smoothness. In view of the structure of the recorder, sometimes the glossy surface of the recording medium must be placed in the direction of the tray side. As a specific embodiment of the present invention, a plain paper is placed as an extra sheet between the recording medium and the tray. Accordingly, the coefficient of static friction ($\mu b$) between the plain paper and the surface of the tray is in the range of about 0.4–2.5, and the coefficient of static friction ($\mu c$) between the plain paper and the treated surface of the recording medium remains in the level of about 0.1–2. It is thus possible to feed the last sheet of the recording medium smoothly.

The extra sheet according to the present invention is not limited provided that it satisfies the aforementioned equation. It includes for example a plain paper, a cardboard, a regenerated paper, a specific coated paper subjected to a specific treatment, a film and the like.

The extra sheet in the present invention is not intended to be printed and thus preferably the one which is not printed by accident, that is the one which is not fed to a recorder. A cardboard is preferably used as an extra sheet in some cases, since the extra sheet having a thickness to some extent is not fed to a recorder.

According to the further preferred embodiment of the present invention, the extra sheet can be fixed by providing a sticking means such as a sticking layer on the surface of the recording-medium-housing side so that the sheet will not move easily in the recording-medium-housing. It is thus possible to make the coefficient of static friction $\mu b$ infinite. The extra sheet which may be fixed semipermanentally is preferably fixed at a strength so that it can be peeled again, more preferably at a strength so that it can be peeled from the recording-medium-housing without leaving the sticking layer on the surface of the housing. Specifically, it is possible to form and use a sticking layer in which the adhesion in the peeling method at 180° defined in JIS Z-0237 is in the range of about 0.1–0.5 gf or the tackiness in the J DOW method is in the range of 1–5. The composition of the sticking layer is not limited and may be the one which has the fixing function as discussed above. In addition, it is possible to provide a released paper to be peeled off before use for the purpose of protecting the sticking layer.

The extra sheet according to the present invention may be placed in the recording-medium-housing at the time when the recording medium is loaded into the recording-medium-housing. According to another embodiment of the present invention, a packed product for ensuring the placement of the extra sheet is provided. Thus, the packed product of the recording medium according to the present invention comprises the recording media which are piled up and the extra sheet. More preferably, the extra sheet is laid on or under the piled-up-recording media. It is particularly preferred to put the extra sheet on the surface of the recording media which have been subjected too a variety of treatments as the cause of the difficulty for the last sheet of the recording media to be fed, i.e. on the glossy surface of the recording medium. When an instruction for placing the recording media with the side where the extra sheet is laid to the recording-media-housing, i.e. the tray, is provided on or in the packed product, it is also advantageous in that the users do not mistake the both sides of the recording media.

What is claimed is:

1. A process for feeding a recording medium into a recorder from a housing in which recording media are piled, comprising the steps of:

providing an extra sheet between the housing and piled recording media, said extra sheet having a first side that contacts a bottom surface of the recording medium and a second side that contacts a surface of the housing, said extra sheet being selected such that a coefficient of static friction between the first side of the extra sheet and the bottom surface of the recording medium is less than $\mu b1$, wherein $\mu b1$ represents the coefficient of static friction between the surface of the housing and the bottom surface of the recording medium, pressing a member against a top surface of the recording medium in the housing, and operating the member in such a manner that the recording medium is drawn out from the housing and fed to the recorder, wherein $\mu a > \mu c$ and $\mu b > \mu c$ where $\mu a$ represents a coefficient of static friction between the member and the top surface of the recording medium against which the member is pressed, $\mu b$ represents the coefficient of static friction between the second side of the extra sheet and the surface of the housing, and $\mu c$ represents the coefficient of static friction between the first side of the extra sheet and the bottom surface of the recording medium which faces the surface of the housing.

2. A process according to claim 1, wherein $\mu a \leqq \mu b1$.

3. A process according to claim 1, wherein the member is a rotatable roller.

4. A process according to claim 1, wherein the top and bottom surfaces of the recording medium are different in condition from each other.

5. A process according to claim 4, wherein the bottom surface of the recording medium is a glossy surface and is piled in the housing with the glossy surface facing the housing.

6. A process according to claim 1, wherein the extra sheet has a thickness that prevents it from being fed to the recorder.

7. A process according to claim 1, and further comprising fixing the extra sheet in the housing with a sticking means on the second side of the extra sheet at the housing.

8. A process according to claim 1, and further comprising providing the piled recording media and the extra sheet as a package.

* * * * *

UNITED STATES PATENT AND TRADEMARK OFFICE

CERTIFICATE OF CORRECTION

PATENT NO. : 6,186,495 B1
DATED : February 13, 2001
INVENTOR(S) : Masaaki Itano, et al.

It is certified that error appears in the above-identified patent and that said Letters Patent is hereby corrected as shown below:

Title page,
Item [30], "2-89629" should read -- 289629/1995 -- and "2-84248" should read -- 284248/1996 --.

Signed and Sealed this

Twenty-third Day of October, 2001

*Attest:*

Nicholas P. Godici

NICHOLAS P. GODICI
*Acting Director of the United States Patent and Trademark Office*

*Attesting Officer*

UNITED STATES PATENT AND TRADEMARK OFFICE

CERTIFICATE OF CORRECTION

PATENT NO. : 6,186,495 B1
DATED : February 13, 2001
INVENTOR(S) : Masaaki Itano et al.

It is certified that error appears in the above-identified patent and that said Letters Patent is hereby corrected as shown below:

Title page,
Item [30], "Nov. 19, 1995" should read -- Nov. 8, 1995 -- and "Oct. 19, 1996" should read -- Oct. 25, 1996 --.

Signed and Sealed this

Twenty-second Day of October, 2002

*Attest:*

*Attesting Officer*

JAMES E. ROGAN
*Director of the United States Patent and Trademark Office*